United States Patent [19]

Murata et al.

[11] Patent Number: 4,771,035

[45] Date of Patent: Sep. 13, 1988

[54] TRANSFER SHEETS FOR THERMAL TRANSFER RECORDING

[75] Inventors: Yukichi Murata, Sagamihara; Shuichi Maeda, Saitama, both of Japan

[73] Assignee: Mitsubishi Chemial Industries Ltd., Tokyo, Japan

[21] Appl. No.: 54,604

[22] Filed: May 27, 1987

[51] Int. Cl.[4] ..... B41M 5/035; B41M 5/26

[52] U.S. Cl. ..... 503/227; 8/471; 428/195; 428/913; 428/914

[58] Field of Search ..... 8/470, 471; 428/195, 428/913, 914, 215, 216, 335, 336, 473.5, 480; 503/227

[56] References Cited

U.S. PATENT DOCUMENTS

| | | | |
|---|---|---|---|
| 4,097,475 | 6/1978 | James | 534/794 |
| 4,313,731 | 2/1982 | Imahori et al. | 534/794 |

FOREIGN PATENT DOCUMENTS

| | | | |
|---|---|---|---|
| 58-17772 | 4/1983 | Japan | 503/227 |
| 60-56838 | 12/1985 | Japan | 503/227 |

*Primary Examiner*—Bruce H. Hess

*Attorney, Agent, or Firm*—Jordan B. Bierman

[57] ABSTRACT

A transfer sheet for thermal transfer recording having a color material layer containing a sublimable dye on one surface of a base film, wherein said sublimable dye is a dicyanoimidazole series dye represented by the formula

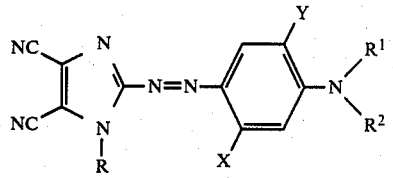

wherein, R, $R^1$, and $R^2$ each represents an allyl group, an alkyl group having 1 to 8 carbon atoms, an alkoxyalkyl group having 3 to 8 carbon atoms, an aralkyl group, a hydroxyalkyl group; X represents a methyl group, a formylamino group, an alkylcarbonylamino group having 1 to 8 carbon atoms, an alkylsulfonylamino group having 1 to 8 carbon atoms, an alkoxycarbonylamino group having 1 to 8 carbon atoms, or a halogen atom; and Y represents a hydrogen atom, an alkoxy group having 1 to 4 carbon atoms, a methyl group, or a halogen atom.

8 Claims, No Drawings

TRANSFER SHEETS FOR THERMAL TRANSFER RECORDING

FIELD OF THE INVENTION

This invention relates to a transfer sheet which is used for sublimation type thermal transfer recording.

BACKGROUND OF THE INVENTION

Hitherto, color recording techniques for facsimile printers, copying machines, television images, etc., have been desired for meeting these desirements, color recording techniques by electrophotography, ink jet printing, thermal transfer recording, etc., have been investigated.

Since in a thermal transfer recording system, the management and operation of apparatus are easy and the cost for the apparatus and supplies are low, the system is considered to be advantageous as compared to other systems.

As a thermal transfer recording system,. there are a melting system of heating a transfer sheet having a heat-melting ink layer formed on a base film by a heating means such as a thermal head, infrared rays, etc., to melt the ink and transferring the molten ink onto a recording material for recording and a sublimation system of heating a transfer sheet having an ink layer containing sublimable dyes formed on a base film by a heating means to sublimate the dyes and transferring the sublimated dyes onto a recording material for recording. In these system, the sublimation system can control the sublimated and transferred amount of dyes by changing the energy given at heating, which facilitates gradation recording, and hence this system is considered to be particularly advantageous.

In the sublimation type thermal transfer recording system, sublimable dyes which are used for the transfer sheet are very important since they give large influences such as the speed of transfer recording, the image quality, storage stability of records, etc., and are required to meet the following conditions.

(1) The dye easily sublimes by the working condition of an ordinary heating means such as a thermal recording head, etc.

(2) The dye does not cause thermal decomposition under the working condition before sublimation.

(3) The dye has a preferred hue for color reproduction.

(4) The dye has a large molecular extinction coefficient.

(5) The dye is stable to heat, light, moisture, chemicals, etc.

(6) The dye can be easily synthesized.

(7) The dye is excellent in ink-making aptitude.

SUMMARY OF THE INVENTION

The object of this invention is to provide a sublimation type thermal transfer sheet containing magenta dyes meeting the aforesaid conditions in the color material layer.

That is, according to this invention, there is provided a transfer sheet for thermal transfer recording having a color material layer containing a sublimable dicyanoimidazole series dye represented by formula (I)

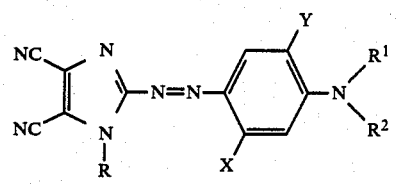

(I)

wherein, R, $R^1$ and $R^2$ each represents an allyl group, an alkyl group having 1 to 8 carbon atoms, an alkoxyalkyl group having 3 to 8 carbon atoms, an aralkyl group, or a hydroxyalkyl group; X represents a methyl group, a formylamino group, an alkylcarbonylamino group having 1 to 8 carbon atoms, an alkylsulfonylamino group having 1 to 8 carbon atoms, an alkoxycarbonylamino group having 1 to 8 carbon atoms, or a halogen atom; and Y represents a hydrogen atom, an alkoxy group having 1 to 4 carbon atoms, a methyl group, or a halogen atom, on one surface of a base film.

DETAILED DESCRIPTION OF THE INVENTION

Then, the invention is described below in detail.

First, the dyes for use in this invention shown by formula (I) described above are explained.

In formula (I) described above, the alkyl group having 1 to 8 carbon atoms shown by R, $R^1$, and $R^2$ includes a methyl group, an ethyl group, a propyl group, a butyl group, a hexyl group, an octyl group, etc., and they may be of a straight chain form or a branched form. In these groups, alkyl groups having 1 to 6 carbon atoms are preferred and alkyl groups having 1 to 4 carbon atoms are particularly preferred.

The alkoxyalkyl group having 3 to 8 carbon atoms shown by R, $R^1$, and $R^2$ includes a methoxyalkyl group, an ethoxyalkyl group, a butoxyalkyl group, etc., and, in particular, an ethyl group substituted by an alkoxy group having 1 to 4 carbon atoms is preferred.

The aralkyl group shown by R, $R^1$, and $R^2$ includes aralkyl groups having 7 or 8 carbon atoms such as a benzyl group, a phenethyl group, etc.

Also, the hydroxyalkyl group shown by R, $R^1$, and $R^2$ includes an alkyl group having 1 to 4 carbon atoms substituted by a hydroxy group and, in particular, a hydroxyethyl group is preferred.

The alkylcarbonylamino group having 1 to 8 carbon atoms shown by X preferably includes alkylcarbonylamino groups having the alkyl moiety of 1 to 4 carbon atoms, such as methyl, ethyl, propyl, butyl, etc., and these alkyl groups as the substituents may be of a straight chain form or a branched form.

The alkoxycarbonylamino group having 1 to 8 carbon atoms shown by X includes alkoxycarbonylamino groups having the alkoxy moiety of 1 to 6 carbon atoms, such as methoxy, ethoxy, propoxy, hexyloxy, etc.

The alkylsulfonylamino group having 1 to 8 carbon atoms shown by X includes alkylsulfonylamino groups having the alkyl moiety of 1 to 4 carbon atoms, such as methyl, ethyl, etc., and, in particular, alkylsulfonylamino groups having the alkyl moiety of 1 to 2 carbon atoms are preferred.

Also, the halogen atom shown by X is preferably a chlorine atom.

The alkoxy group having 1 to 4 carbon atoms shown by Y includes a methoxy group, an ethoxy group, etc., and, in particular, a methoxy group is preferred.

In these dyes shown by formula (I), the dyes of the formula wherein R is an allyl group, an alkyl group having 1 to 8 carbon atoms, or an aralkyl group having 7 or 8 carbon atoms, $R^1$ and $R^2$ are an alkyl group having 1 to 8 carbon atoms, an aralkyl group having 7 or 8 carbon atoms, an alkoxyalkyl group having 3 to 8 carbon atoms, or a hydroxyethyl group, X is a methyl group, an alkylcarbonylamino group having 1 to 4 carbon atoms, an alkoxycarbonylamino group having 1 to 6 carbon atoms, an alkylsulfonylamino group having 1 or 2 carbon atoms, a methoxy group, a formylamino group, or a chlorine atom, and Y is a hydrogen atom or a methoxy group are preferred. Particularly preferred dyes are those of formula (I) wherein R is an allyl group or an alkyl group having 1 to 6 carbon atoms, X is an alkylcarbonylamino group having 1 to 4 carbon atoms, Y is a hydrogen atom, and $R^1$ and $R^2$ are an alkyl group having 1 to 6 carbon atoms.

The dyes for use in this invention can be produced by conventional production processes. For example, the dye of formula (I) is obtained by diazotizing a 2-amino-4,5-dicyano-imidazole shown by formula(II)

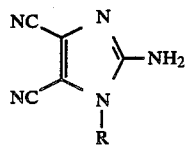

(II)

wherein, R has the same significance as defined above according to an ordinary method and coupling the product with an aniline shown by formula (III)

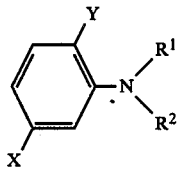

(III)

wherein, $R^1$, $R^2$, Y and X have the same significance as defined above.

Specific examples of the dyes for use in this invention are shown in Examples described hereinbelow although the dyes in this invention are not limited to them.

In the case of applying the aforesaid dyes for the thermal transfer sheet of this invention, an ink is prepared by dissolving the dye(s) in a medium together with a binder or dipersing them in the medium as fine particles and the ink is coated on a base film followed by drying to form a color material layer on the base film.

As the binder which is used for preparing the ink, there are water-soluble resins such as cellulose series resins, acrylic acid series resins, starch series resins, etc., and resins soluble in organic solvent or water, such as acrylic resins, methacrylic resins, polystyrene, polycarbonate, polysulfone, polyether sulfone, polyvinyl butyral, ethyl cellulose, acetyl cellulose, AS resins, ABS resins, polyester resins, phenoxy resins, etc.

Also, as the medium for preparing the ink for use in this invention, there are, in addition to water, alcohols such as methanol, iso-propanol, iso-butanol, etc., cellosolves such as methylcellosolve, ethylcellosolve, etc., aromatics such as toluene, xylene, chlorobenzene, etc., esters such as ethyl acetate, butyl acetate, etc., ketones such as acetone, methyl ethyl ketone, methyl isobutyl ketone, cyclohexanone, etc., chlorine series solvents such as methylene chloride, chloroform, trichloroethylene, etc., ethers such as tetrahydrofuran, dioxane, etc., and other organic solvents such as N,N-dimethylformamide, N-methylpyrrolidone, etc.

The aforesaid inks may further contain, if necessary, organic or inorganic non-sublimable fine particles, dispersing agents, antistatic agents, blocking preventing agents, defoaming agents, antioxidants, viscosity controlling agents, etc., in addition to the aforesaid components.

The base film for the transfer sheet of this invention is required to have the properties that the film is dense and thin for increasing the heat conductivity, the film has high heat resistance, a uniform transfer layer or color material layer can be coated on the film, the film has good smoothness for improving the contact with a thermal head, and further the ink does not ooze into the back side of the film. As such a base film, there are tissue papers such as condenser papers, glassine papers, etc., and films of plastics having high heat resistance, such as polyester, polyamide, polyimide, etc. The thickness of these films is in the range of from 3 μm to 50 μm. In these materials, polyethylene terephthalate films and polyimide films are preferred and polyethylene terephthalate films are particularly preferred.

The thermal transfer sheet of this invention fundamentally has a color material layer containing the aforesaid dye(s) on the surface of a base film but as the case may be, a smooth heat-resisting layer may be formed on the back surface of the base film for improving the running property and heat resistance for a thermal head. Such a back layer is formed by coating additives such as an inert inorganic compound (e.g., fine silica particles, etc.,), a lubricant, a surface active agent, etc., together with a resin such as an epoxy resin, an acrylic resin, a urethane series resin, a polycarbonate series resin, etc.

For coating the ink on a base film, a reverse roll coater, a gravure coater, rod coater, air doctor coater, etc., can be used. The ink may be coated at a dry thickness of from 0.1 μm to 5μm (Yuji Harazaki, Coating System, published by Maki Shoten, 1979).

The azoic dyes for use in this invention shown be formula (I) described above have clear magenta color and hence are suitable for obtaining full color recording of good color reproducibility by combining with proper yellow dyes and cyan dyes. Furthermore, since the dyes of formula (I) are liable to sublime and have a large molecular extinction coefficient, the dyes can give records of high color density at high speed without giving large load on a heating means such as a thermal head, etc. Furthermore, since the dyes for use in this invention are stable to heat, light, moisture, chemicals, etc., they do not cause thermal decomposition and the records obtained are excellent in storage stability. Also, since the dyes for use in this invention have good solubility for organic solvents and good dispersibility for water, an ink of high concentration uniformly dissolved or dispersed in an organic solvent or water can be easily prepared and by using the ink, a transfer sheet uniformly coated with the dye(s) at high concentration can be obtained. Accordingly, by using the transfer sheet of this invention, records having good homogeneity and color density can be obtained.

Then, the following examples are intended to illustrate this invention but not to limit it in any way.

EXAMPLE 1

(a) Preparation of Ink

| | |
|---|---|
| Dye shown below | 10 g |
| Cellulose Acetate (L-30, trade name, made by Daicel Chemical Industries, Ltd.) | 10 g |
| Methy Ethyl Ketone | 80 g |
| Total | 100 g |

Dye

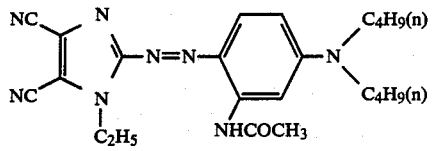

A mixture of the above components was treated by a paint conditioner for 10 minutes to provide an ink. In this case, the dye and the resin were completely dissolved in the solvent and the ink could be obtained as a uniform solution.

(b) Preparation of Transfer Sheet

The above-described ink was coated on a polyimide film of 15 μm in thickness using a bar coater (No. 1, made by RK Print Coat Instrument Co.) and dried to provide a transfer sheet.

(c) Transfer Recording

The ink-coated surface of the transfer sheet described above was superposed on a recording material and by recording under the recording condition shown below using a thermal recording head, a clear magenta color record having a uniform color density of 1.20 could be obtained.

Recording Condition

Line density of main scanning and side scanning: 4 dots/mm
Recording electric power: 0.6 Watts/dot
Heating time of head: 10 m sec.

In addition, the recording material was prepared by coating a liquid composition prepared by mixing 10 g of an aqueous dispersion of 34% by weight saturated polyester (Byronal MD-1200, trade name, made by Toyobo Co., Ltd.) and 1 g of silica (Nipsil E220A, trade name, made by Nippon Silica Kogyo K.K.) on a wood free paper of 200 μm in thickness using a bar coater (No. 3, made by RK Print Coat Instrument Co.) and dried.

The color density was measured using a densitometer, RD-514, trade name, made by Macbeth Co. (Filter: Wratten No. 58).

When the light resistance test of the record obtained was practiced using a carbon arc fade-o-meter (made by Suga Shikenki K.K.), almost no discoloring and fading were observed after the irradiation for 40 hours. Also, it was confirmed that the transfer sheet and the records obtained were stable to heat and moisture and was excellent in storage stability in the dark.

EXAMPLE 2

The preparation of ink, the preparation of transfer sheet, and transfer recording were performed by the same way as in Example 1 using each of the dyes shown in Table 1 below in place of the dye used in Example 1. In each result, a clear magenta color record having the color density shown in Table 1 could be obtained.

The results of the light resistance test of the records obtained and the dark storage stability test of the transfer sheet and the record were good.

In addition, the absorption maximum wave lengths of dyes in Table 1 below were the values measured in chloroform.

TABLE 1

Dye Structure

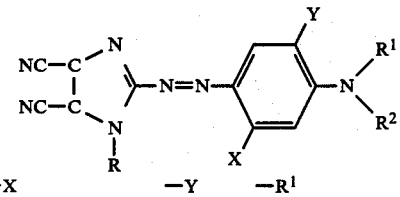

| Sample No. | —R | —X | —Y | —R¹ | —R² | Color Density of Record | Absorption Maximum of Dye (nm) |
|---|---|---|---|---|---|---|---|
| 2-1 | $-CH_3$ | $-NHCOCH_3$ | —H | $-C_2H_5$ | $-C_2H_5$ | 1.20 | 524 |
| 2-2 | $-C_2H_5$ | " | " | " | " | 1.20 | 526 |
| 2-3 | $-C_4H_9(n)$ | " | " | " | " | 1.20 | 534 |
| 2-4 | $-C_8H_{17}(n)$ | " | " | " | " | 1.15 | 536 |
| 2-5 | $-CH_2CH(C_2H_5)C_4H_9$ | " | " | " | " | 1.15 | 537 |
| 2-6 | $-C_3H_7(n)$ | " | " | " | " | 1.20 | 532 |
| 2-7 | 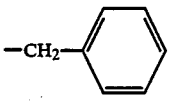 | $-CH_3$ | " | " | " | 1.05 | 525 |
| 2-8 | $-C_3H_7(n)$ | $-NHCOCH_3$ | $-OCH_3$ | " | " | 1.15 | 567 |
| 2-9 | $-C_2H_5$ | $-NHCOC_2H_5$ | —H | " | " | 1.20 | 524 |
| 2-10 | " | $-NHCOC_3H_7(n)$ | " | " | " | 1.20 | 523 |
| 2-11 | " | —NHCOH | " | " | " | 1.15 | 520 |
| 2-12 | " | $-NHCOOC_2H_5$ | " | " | " | 1.15 | 519 |

TABLE 1-continued

Dye Structure

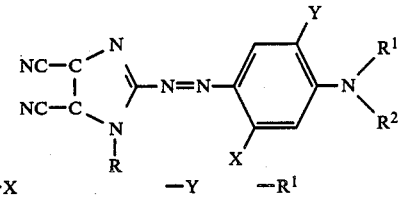

| Sample No. | —R | —X | —Y | —$R^1$ | —$R^2$ | Color Density of Record | Absorption Maximum of Dye (nm) |
|---|---|---|---|---|---|---|---|
| 2-13 | " | —$NHCOOC_6H_{13}(n)$ | " | " | " | 1.15 | 518 |
| 2-14 | " | —$NHSO_2CH_3$ | " | " | " | 1.10 | 536 |
| 2-15 | " | —$NHSO_2C_2H_5$ | " | " | " | 1.10 | 532 |
| 2-16 | " | —$CH_3$ | " | —$CH_2$— 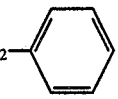 | " | 1.10 | 510 |
| 2-17 | " | —Cl | " | —$C_2H_5$ | " | 1.15 | 511 |
| 2-18 | —$CH_3$ | —$NHCOC_3H_7$ | " | " | " | 1.15 | 526 |
| 2-19 | " | —$NHCOC_2H_5$ | " | " | " | 1.15 | 525 |
| 2-20 | —$C_2H_5$ | —$NHCOCH_3$ | " | —$CH_3$ | —$CH_3$ | 1.20 | 522 |
| 2-21 | —$CH_3$ | " | " | " | " | 1.20 | 519 |
| 2-22 | —$C_2H_5$ | —$NHCOC(CH_3)_2CH_3$ | " | —$C_2H_5$ | —$C_2H_5$ | 1.10 | 521 |
| 2-23 | —$CH_2$— 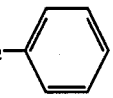 | —$NHCO_2CH_3$ | " | " | " | 1.00 | 520 |
| 2-24 | " | —$NHCOC_3H_7$ | " | " | " | 1.00 | 529 |
| 2-25 | —$C_2H_4$— 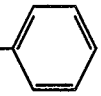 | —$CH_3$ | " | " | " | 1.10 | 516 |
| 2-26 | —$CH_3CH{=}CH_3$ | —$NHCOCH_3$ | " | " | " | 1.20 | 525 |
| 2-27 | —$C_2H_5$ | " | " | " | —$C_2H_4OCH_3$ | 1.15 | 520 |
| 2-28 | " | " | " | " | —$C_2H_4OH$ | 1.15 | 524 |
| 2-29 | " | " | " | " | —$C_2H_4OC_4H_9(n)$ | 1.10 | 522 |
| 2-30 | " | " | " | —$C_2H_4OCH_3$ | —$C_2H_4OCH_3$ | 1.00 | 513 |
| 2-31 | " | " | " | —$C_2H_5$ | —$C_2H_4$— 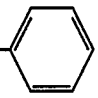 | 1.05 | 524 |
| 2-32 | " | " | " | —$C_4H_9(n)$ | " | 1.05 | 526 |
| 2-33 | " | " | " | —$C_5H_{11}(n)$ | —$C_5H_{11}(n)$ | 1.20 | 530 |
| 2-34 | " | " | " | —$C_6H_{13}(n)$ | —$C_6H_{13}(n)$ | 1.20 | 530 |
| 2-35 | " | " | " | —$C_2H_5$ | —$C_8H_{17}(n)$ | 1.15 | 530 |
| 2-36 | " | " | " | " | —$CH_2CH(C_2H_5)C_4H_9(n)$ | 1.15 | 530 |
| 2-37 | —$C_4H_9(n)$ | " | " | —$C_4H_9(n)$ | —$C_4H_9(n)$ | 1.20 | 529 |
| 2-38 | —$C_2H_5$ | —$CH_3$ | —$OCH_3$ | " | " | 1.20 | 528 |

EXAMPLE 3

An ink of the following composition was prepared using the dicyanoimidazole series dye as used in Example 1.

| | |
|---|---|
| Dye | 10 g |
| Ethyl Cellulose (made by Hercules Powder Co.) | 10 g |

-continued

| | | |
|---|---|---|
| Methyl Ethyl Ketone | | 80 g |
| | Total | 100 g |

By following the same way as in Example 1 using the ink thus prepared, the preparation of transfer sheet and transfer recording were performed. The result thereof showed that clear magenta color records of 1.20 in color density and having good storage stability and light fastness could be obtained.

EXAMPLE 4

(a) Preparation of Transfer Sheet

A coating liquid for a heat-resisting smooth layer having the composition shown below was prepared, coated on one surface of a biaxially oriented polyethylene terephthalate film of 6 μm in thickness by a wire bar coater and, after drying, heat-treated at 60° C. for 3 days to form a heat-resisting smooth layer of 2 μm in thickness.

Composition of Coating Liquid for Heatresistant Smooth Layer

| | |
|---|---|
| Cellulose Acetate (acetylation degree 55%, average polymerization degree 150; L-30, trade name, made by Daicel Chemical Industries, Ltd.) | 8.3 wt. parts |
| Isocyanate (75% ethyl acetate soln. of the reaction product of tolylene diisocyanate and trimethylolpropane at 3:1 by mol ratio, Coronate L, trade name, made by Nippon Polyurethane Kogyo K.K.) | 5.0 wt. parts |
| Amine Series Catalyst (NY-3, trade name, made by Nippon Polyurethane Kogyo K.K.) | 0.05 wt. parts |
| Phosphoric Acid Ester of Polyoxyethylene Alkyl Ether (Plysurf A208B, trade name, made Dai-Ichi Kogyo Seiyaku Co., Ltd.) | 2.0 wt. parts |
| Benzoguanamine Resin Particles (Epostar (S), trade name, made by Nippon Shokubai Kagaku Kogyo Co.) | 0.5 wt. parts |
| Methyl Ethyl Ketone | 84.2 wt. parts |

Then, a coating liquid for color material layer having the following composition was prepared, coated on the opposite surface of the base film to the surface carrying the heat-resisting smooth layer by means of a wire bar coater, and dried to form a color material layer of about 1 μm in thickness. Thus, a transfer sheet for heat-sensitive transfer recording was prepared.

Composition of Coating Liquid for Colored Layer

| | |
|---|---|
| Dye shown below | 10 wt. parts |
| Polycarbonate Resin | 10 wt. parts |
| Toluene | 80 wt. parts |

Formula of dye

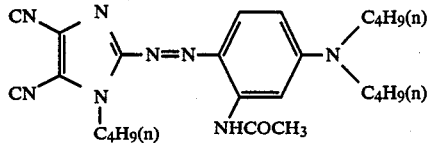

(b) Transfer Recording

Transfer recording was performed using the transfer sheet described above by the same manner as Example 1 and a clear magenta color record having uniform color density of 1.50 could be obtained.

What is claimed is:

1. A transfer sheet for thermal transfer recording system having a color material layer containing a sublimable dye and a binder on one surface of a base film, wherein said sublimable dye contained in the color material layer is a dye represented by formula (I)

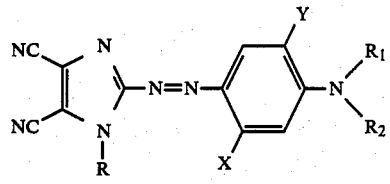

(I)

wherein, R, $R_1$, and $R_2$ each represents an allyl group, an alkyl group having 1 to 8 carbon atoms, an alkoxyalkyl group having 3 to 8 carbon atoms, an aralkyl group, or a hydroxyalkyl group; X represents a methyl group, a formylamino group, an alkylcarbonylamino group having 1 to 8 carbon atoms, an alkylsulfonylamino group having 1 to 8 carbon atoms, an alkoxycarbonylamino group having 1 to 8 carbon atoms, or a halogen atom; and Y represents a hydrogen atom, an alkoxy group having 1 to 4 carbon atoms, a methyl group, or a halogen atom.

2. The transfer sheet as claimed in claim 1, wherein in formula (I), R represents an allyl group, an alkyl group having 1 to 8 carbon atoms, or an aralkyl group having 7 or 8 carbon atoms; $R_1$ and $R_2$ represent an alkyl group having 1 to 8 carbon atoms, an aralkyl group having 7 or 8 carbon atoms, an alkoxyalkyl group having 3 to 8 carbon atoms, or a hydroxyethyl group; X represents a methyl group, an alkylcarbonylamino group having 1 to 4 carbon atoms, an alkoxycarbonylamino group having 1 to 6 carbon atoms, an alkylsulfonylamino group having 1 or 2 carbon atoms, a methoxy group, a formylamino group, or a chlorine atom; and Y represents a hydrogen atom, or a methoxy group.

3. The transfer sheet as claimed in claim 1, wherein in formula (I), R represents an allyl group or an alkyl group having 1 to 6 carbon atoms; $R_1$ and $R_2$ represent an alkyl group having 1 to 6 carbon atoms; X represents an alkylcarbonylamino group having 1 to 4 carbon atoms; and Y represents a hydrogen atom.

4. The transfer sheet as claimed in claim 1, wherein the base film is a polyimide film or a polyethylene terephthalate film.

5. The transfer sheet as claimed in claim 1, wherein the thickness of the base film is from 3 μm to 50 μm.

6. The transfer sheet as claimed in claim 1, wherein the thickness of the color material layer is from 0.1 μm to 5 μm.

7. The transfer sheet as claimed in claim 1, wherein the binder is a water-soluble resin selected from a cellulose series resin, an acrylic acid series resin, and a starch series resin.

8. The transfer sheet as claimed in claim 1, wherein the binder is an organic solvent-soluble resin selected from an acrylic resin, a methacrylic resin, polystyrene, polycarbonate, polysulfone, polyether sulfone, acetyl cellulose, an AS resin, an ABS resin, a polyester resin, a phenoxy resin, polyvinyl butyral, and ethyl cellulose.

* * * * *